US005129450A

United States Patent [19]

Hung

[11] Patent Number: 5,129,450

[45] Date of Patent: Jul. 14, 1992

[54] HYDRAULIC CIRCUIT WITH A COOLING DEVICE

[76] Inventor: Michael Hung, 9-16, Nan Kan Hsia, Nan Kan, Lu Chu Hsiang, Tao Yuan County, Taiwan

[21] Appl. No.: 773,491

[22] Filed: Oct. 9, 1991

[51] Int. Cl.[5] ..... F28F 3/12

[52] U.S. Cl. ..... 165/168; 482/53; 482/113

[58] Field of Search ..... 272/70.2, 70, 130; 165/168, 169, 185, 916

*Primary Examiner*—Noah Kamen

*Attorney, Agent, or Firm*—Wenderoth, Lind & Ponack

[57] ABSTRACT

A hydraulic circuit with a cooling device including mainly two hydraulic cylinders, a cooling device in the form of a rectangular structure having two oil channels each for connecting to a hydraulic cylinder and a spare tiny passage to keep on connecting to the oil channels, a control valve to close and open the oil channels, a plurality of cooling fins formed perpendicular to a side of the cooling device, and a fan for fast cooling effect whereby the hydraulic cylinders can be driven for reciprocating movements in two opposite directions.

3 Claims, 3 Drawing Sheets

HYDRAULIC CIRCUIT WITH A COOLING DEVICE

BACKGROUND OF THE INVENTION (a) Field of the Invention

The present invention related to a hydraulic circuit with a cooling device including mainly two hydraulic cylinders, a cooling device in the form of a rectangular structure having two oil channels each for connecting to a hydraulic cylinder and a spare tiny passage to keep on connecting to the oil channels, a control valve to close and open the oil channels, a plurality of cooling fins formed perpendicular to a side of the cooling device, and a fan for fast cooling effect whereby the hydraulic cylinders can be driven for reciprocating movements in two opposite directions with controllable load for use in, for example, exercise equipment such as walking exercise machine, boat rower, or indoor bicycle.

(b) Description of the Prior Art

Conventionally each exercise equipment, such as walking exercise machine, boat rower, or indoor bicycle, uses two hydraulic cylinders connecting to pedals or oars to provide load for stepping or rowing by a control on hydraulic load. However, for each adjustment of hydraulic load, the hydraulic cylinders must be adjusted respectively. Moreover, the frequent operation of pistons results in rising of hydraulic oil temperature and consequently damages oil seals, and forcefully stepping or rowing without prior adjustment when their control valves are closed will result in damage to the hydraulic cylinders.

SUMMARY OF THE INVENTION

The main object of the present invention is to provide a hydraulic circuit with a cooling device including mainly two hydraulic cylinders, a cooling device in the form of a rectangular structure having two oil channels each for connecting to a hydraulic cylinder and a spare tiny passage to keep on connecting to the oil channels, and a control valve to close and open the oil channels so as to provide a precise control on hydraulic load of both the hydraulic cylinders simultaneously and the load of both the hydraulic cylinders can be easily adjusted by turning of a single control valve.

Another object of the present invention is to provide a hydraulic circuit with a cooling device having a plurality of cooling fins formed perpendicular to a side of the cooling device, and a fan installed at an end of the cooling device for fast cooling effect when hydraulic oil temperature is rising in the oil channels in order to protect oil seals in the hydraulic cylinders from high temperature and to assure proper operation of the hydraulic cylinders.

Another object of the present invention is to provide a hydraulic circuit with a cooling device having an appropriate tiny passage formed between the channels as a spare oil passage to keep on connecting to the channels even when the control valve is completely closed in order to maintain a thoroughly connection between the oil channels to assure that the cylinders will not burst when improper external force is applied to the cylinders.

DETAILED DESCRIPTION OF THE PREFERRED EMBODIMENTS

Figure 1:
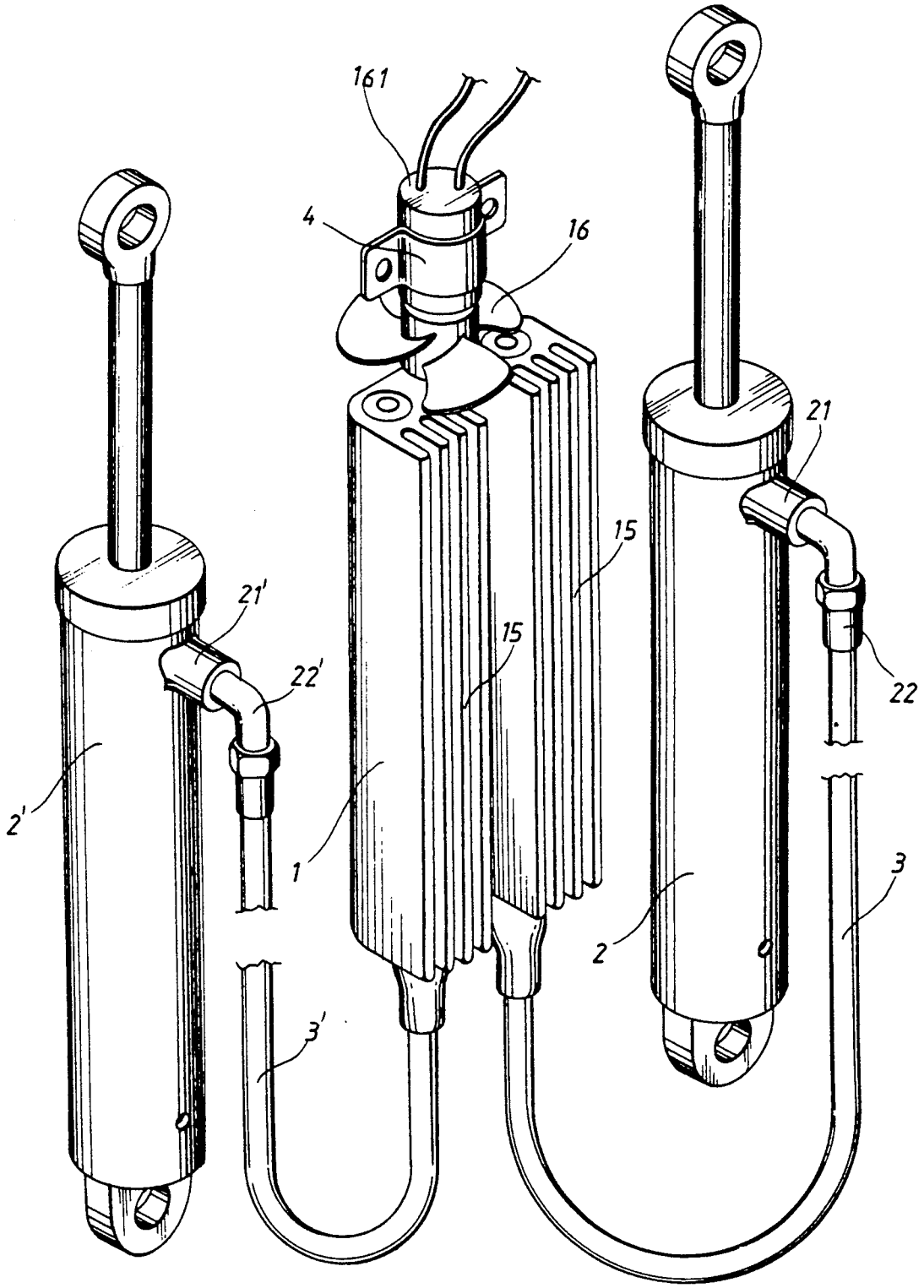
FIG. 1 is a perspective view of a hydraulic circuit with a cooling device according to the present invention.
Figure 2:
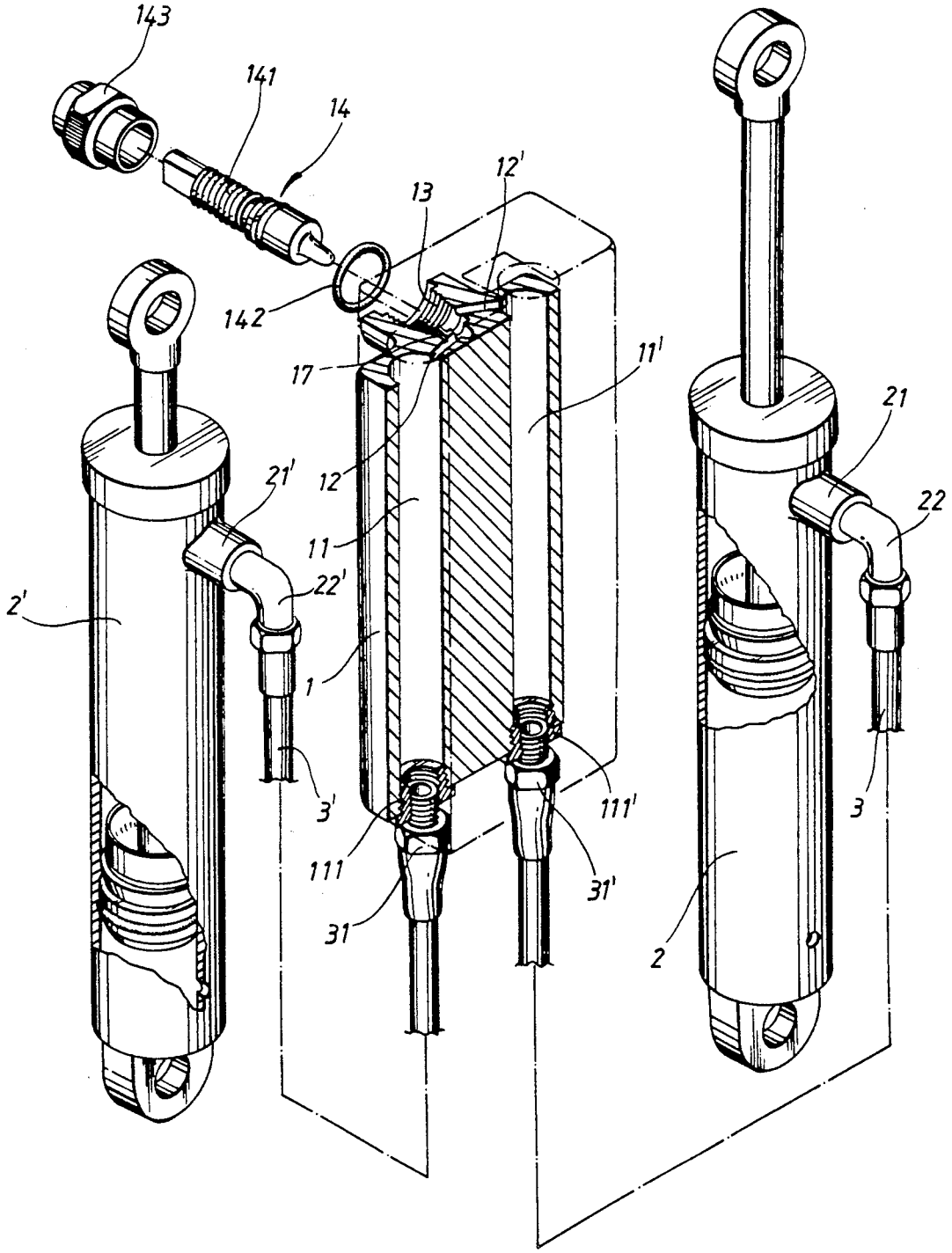
FIG. 2 is a fragmented sectional view of the hydraulic circuit with a cooling device according to the present invention.

As shown in FIGS. 1 and 2, the present invention includes mainly a cooling device (1) for connecting to two hydraulic cylinders (2 and 2') via two hydraulic hoses (3 and 3'). These hydraulic hoses (3 and 3') are for flowing of hydraulic oil through the cooling device (1) to drive the hydraulic cylinders (2 and 2') for reciprocating movements in two opposite directions. The hydraulic cylinders (2 and 2') are substantially same with the conventional hydraulic cylinder, each of them has an oil outlet (21 or 21') at a side of its wall, to which an elbow (22 or 22') is connected for connection of a hydraulic hose (3 or 3'). The present invention is mainly characterized by the provision of the cooling device (1), through which the said hydraulic hoses (3 and 3') are connected to an oil tank for operation of the hydraulic cylinders (2 and 2').

The cooling device (1) is in the form of an appropriate rectangular structure having two longitudinal oil channel (11 and 11'), one at each lateral side. A threaded bushing (111 or 111') is placed in the lower end of each of the oil channels (11 and 11') for fitting of a connector (31 or 31') connecting to each of the hydraulic hoses (3 and 3'). The upper ends of both oil channels (11 and 11') are closed, but each of them has a hole (12 or 12') to connect to the other so that the two oil channels (11 and 11') are connecting to each other via the holes (12 and 12'). A threaded cavity (13) is formed at a side of the cooling device (1) to connect to the holes (12 and 12'). A control valve (14) is installed in the threaded cavity (13) to control flowing of oil between the oil channels (11 and 11') through the holes (12 and 12') in order to adjust hydraulic oil flow rate, and consequently adjust load applied to the respective hydraulic cylinders (2 and 2').

Following the operations of the hydraulic cylinders, the temperature of hydraulic oil flowing between the oil channels (11 and 11') is rising. Therefore, the cooling device (1) is preferably made of material having good heat dissipation property, and has a plurality of cooling fins (15) formed perpendicular to the body of the cooling device (1) and a cooling fan (16) driven by a motor (161) at an end of the cooling device (1) to provide a good cooling effect.

Figure 3:
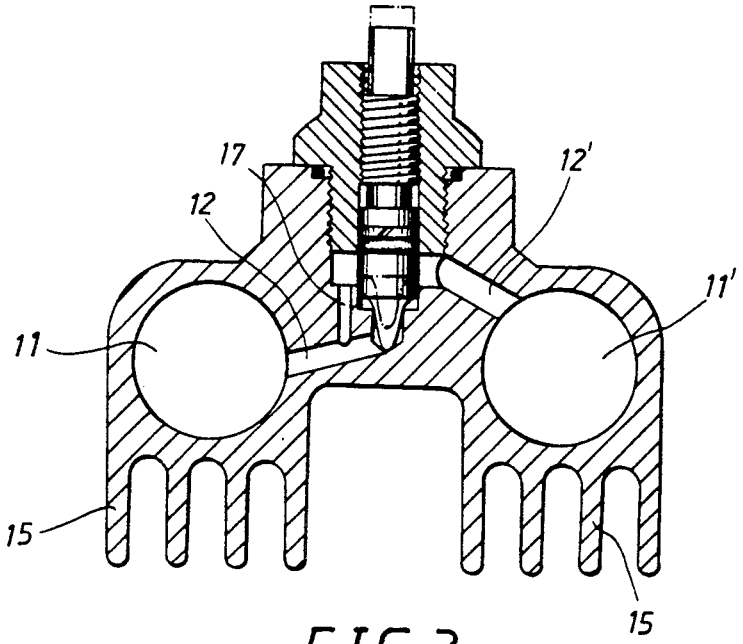
FIG. 3 is a sectional view of the hydraulic circuit with a cooling device according to the present invention.

To prevent from bursting of cylinders (2 and 2') due to wrong operation when the control valve (14) is completely closed, an appropriate tiny passage (17) is formed between the channels (11 and 11') as a spare oil passage to keep on connecting to the channels (11 and 11') regardless of whether the control valve (14) is opened or closed, as shown in FIG. 3. The tiny passage (17) is designed to maintain a thoroughly connection between the oil channels (11 and 11') to assure that the cylinders (2 and 2') will not burst when improper external force is applied to the cylinders (2 and 2')

Figure 4:
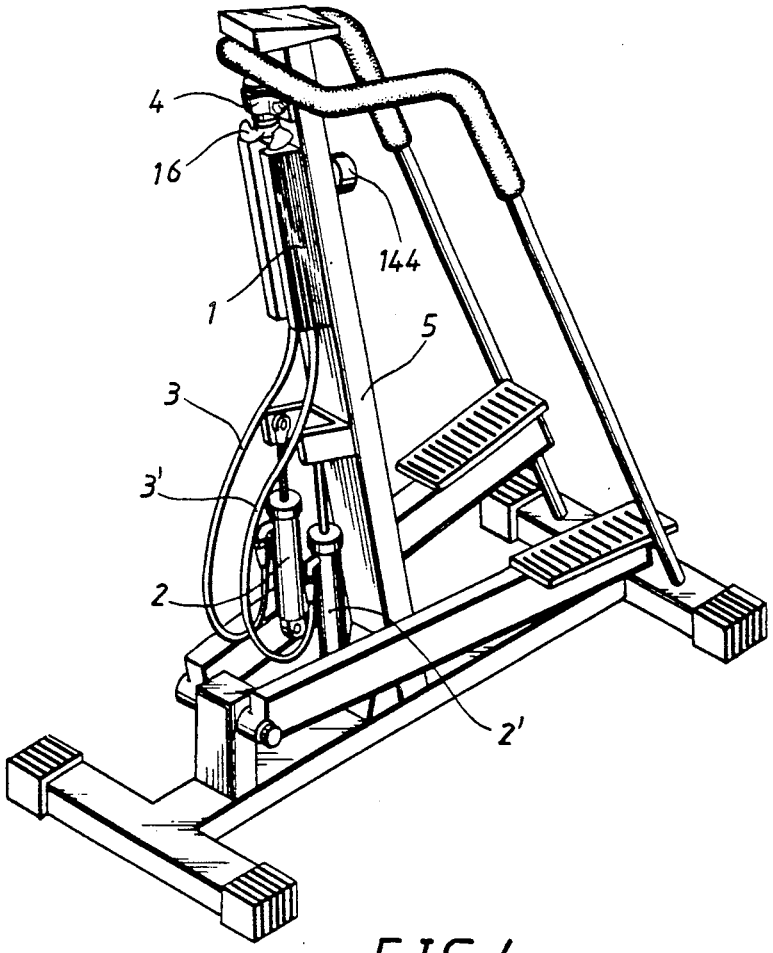
FIG. 4 illustrates the application of the hydraulic circuit with a cooling device according to the present invention to a walking exercise machine.

The hydraulic circuit with a cooling device described above is mainly used in sporting equipment, such as walking exercise machine, boat rower, indoor bicycle, and the like, in which two cylinders are used for pedals or oars to provide a certain load for the pedals or oars to perform a regular vertically reciprocating movement. As shown in FIG. 4 which shows an application of the present invention in walking exercise machine, the cooling device (1) is installed by fitting the motor (161) to a frame (5) of the walking exercise machine by means of a fixing element (4). The control valve (14) is fixed at the frame (5) for adjustment of flow rate. The control valve (14) has an appropriate thread (141) on its body which has an appropriate tapered front end for fixing into the threaded cavity (13) at the cooling device (1) with an oil seal (142). By turning of the valve body in normal or reverse direction, the load between the oil channels (11 and 11') can be adjusted. An appropriate adapter (143) and knob (143) are incorporated with the valve body for adjustment of load by turning the knob (144) directly.

I claim:

1. A hydraulic circuit with a cooling device including mainly two hydraulic cylinders and a cooling device connecting to said hydraulic cylinders so as the load can be controlled at the cooling device, wherein the cooling device is in the form of an appropriate rectangular structure having two longitudinal oil channels, one at each lateral side, and each having an closed upper end, a lower open end for connecting to a hydraulic hose, and a hole to connect to the other oil channel so that the two oil channels are connecting to each other via the said holes;

a threaded cavity formed at a side of the cooling device to connect to the said holes;

a control valve installed in the threaded cavity to control flowing of oil between the oil channels through the holes in order to adjust hydraulic oil flow rate, and consequently adjust load applied to the respective hydraulic cylinders; and a plurality of cooling fins formed perpendicular to a side of the cooling device.

2. A hydraulic circuit with a cooling device as claimed in claim 1 wherein an appropriate tiny passage is formed between the channels as a spare oil passage to keep on connecting with the channels regardless of whether the control valve is opened or closed.

3. A hydraulic circuit with a cooling device as claimed in claim 1 wherein a fan driven by a motor is installed at an end of the cooling device for fast cooling effect.

* * * * *